US008919765B2

(12) United States Patent
Kawashima

(10) Patent No.: US 8,919,765 B2
(45) Date of Patent: Dec. 30, 2014

(54) SHEET FEED APPARATUS, AND IMAGE FORMING APPARATUS AND IMAGE READING APPARATUS INCLUDING THE SAME

(71) Applicant: KYOCERA Document Solutions Inc., Osaka-shi, Osaka (JP)

(72) Inventor: Tetsuro Kawashima, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/185,769

(22) Filed: Feb. 20, 2014

(65) Prior Publication Data

US 2014/0239583 A1 Aug. 28, 2014

(30) Foreign Application Priority Data

Feb. 22, 2013 (JP) ..... 2013-033309

(51) Int. Cl.

| | |
|---|---|
| ***B65H 1/08*** | (2006.01) |
| ***B65H 3/06*** | (2006.01) |
| ***B65H 1/06*** | (2006.01) |
| ***B65H 1/26*** | (2006.01) |
| ***B65H 7/02*** | (2006.01) |

(52) U.S. Cl.

CPC ..... *B65H 1/08* (2013.01); *B65H 3/0684* (2013.01); *B65H 2405/1117* (2013.01); *B65H 1/06* (2013.01); *B65H 1/266* (2013.01); *B65H 3/0607* (2013.01); *B65H 2405/113* (2013.01); *B65H 2405/1136* (2013.01); *B65H 2405/114* (2013.01); *B65H 2405/324* (2013.01); *B65H 2407/21* (2013.01); *B65H 3/06* (2013.01); *B65H 7/02* (2013.01)

USPC ..... 271/126; 271/147

(58) Field of Classification Search

CPC ..... B65H 1/08; B65H 3/0684; B65H 2405/1113; B65H 2405/1115; B65H 2405/11151; B65H 2405/1117

USPC ..... 271/126, 127, 147

See application file for complete search history.

(56) References Cited

U.S. PATENT DOCUMENTS

| | | | | |
|---|---|---|---|---|
| 8,016,283 | B2 * | 9/2011 | Ueda et al. | 271/117 |
| 8,720,884 | B2 * | 5/2014 | Araishi | 271/147 |
| 8,746,683 | B2 * | 6/2014 | Yamamoto | 271/171 |
| 2011/0187047 | A1 * | 8/2011 | Ichikawa et al. | 271/127 |
| 2012/0228820 | A1 * | 9/2012 | Otsuki | 271/147 |
| 2013/0161899 | A1 * | 6/2013 | Ito et al. | 271/147 |
| 2013/0207337 | A1 * | 8/2013 | Tokisawa et al. | 271/126 |

FOREIGN PATENT DOCUMENTS

JP 2009096598 A 5/2009

* cited by examiner

*Primary Examiner* — David H Bollinger

(74) *Attorney, Agent, or Firm* — Alleman Hall McCoy Russell & Tuttle LLP

(57) ABSTRACT

A sheet feed apparatus has sheet tray, sheet conveyance path, sheet feed roller, lift plate, and guide wall. Sheet feed roller is disposed, downstream of sheet tray in sheet conveyance direction, above central portion of sheet tray in sheet width direction perpendicular to sheet conveyance direction, so as to face central portion. Lift plate is movable upward and downward to allow sheet to contact with sheet feed roller. Guide wall is disposed downstream of lift plate in sheet conveyance direction and spaced from lift plate with predetermined gap, to guide the conveyed sheet in diagonally upward direction intersecting placing surface of sheet tray. Both end portions in sheet width direction in front edge portion, of lift plate, facing guide wall are provided with end guide surfaces, respectively, which are inclined upward relative to central portion in sheet width direction.

10 Claims, 12 Drawing Sheets

SHEET FEED APPARATUS, AND IMAGE FORMING APPARATUS AND IMAGE READING APPARATUS INCLUDING THE SAME

INCORPORATION BY REFERENCE

This application is based upon and claims the benefit of priority from the corresponding Japanese Patent Application No. 2013-033309 filed on Feb. 22, 2013, the entire contents of which are incorporated herein by reference.

BACKGROUND

The present disclosure relates to a sheet feed apparatus that feeds a sheet, and an image forming apparatus and an image reading apparatus including the same.

Conventionally, an openable and closable manual sheet feed tray mounted in a main body of an image forming apparatus has been known as a sheet tray on which a sheet is placed. The manual sheet feed tray is opened with respect to the main body of the apparatus, and a sheet is placed on the manual sheet feed tray. The sheet is conveyed into the main body of the apparatus by a sheet feed roller, and an image is formed on the sheet.

In a conventional manual sheet feed tray, a sheet is fed by a sheet feed roller disposed at a central portion in a sheet width direction. In this case, the sheet is fed stably while being held by the sheet feed roller at a central portion of the sheet in the sheet width direction. Each end portion of the sheet in the sheet width direction is free from the holding force of the sheet feed roller and therefore displaceable in a direction intersecting a surface of the sheet. In this case, the end portion of the sheet may enter a gap between the manual sheet feed tray and the main body of the apparatus, and the sheet may be bent or defectively fed.

SUMMARY

A sheet feed apparatus according to one aspect of the present disclosure includes a sheet tray, a sheet conveyance path, a sheet feed roller, a lift plate, and a guide wall. The sheet tray includes a placing surface on which a sheet is placed. The sheet conveyance path is a path which is extended from the sheet tray and through which the sheet is conveyed in a predetermined sheet conveyance direction. The sheet feed roller is disposed, downstream of the sheet tray in the sheet conveyance direction, above a central portion of the sheet tray in a sheet width direction perpendicular to the sheet conveyance direction, so as to face the central portion of the sheet tray, and the sheet feed roller is rotationally driven to feed the sheet into the sheet conveyance path. The lift plate is disposed on the downstream side of the sheet tray in the sheet conveyance direction to support the sheet on a top surface thereof, and the lift plate is movable upward and downward to allow the sheet to contact with the sheet feed roller. The guide wall is disposed downstream of the lift plate in the sheet conveyance direction and spaced from the lift plate with a predetermined gap, to guide the sheet conveyed by the sheet feed roller in a diagonally upward direction intersecting the placing surface. Both end portions in the sheet width direction in a front edge portion, of the lift plate, facing the guide wall are provided with end guide surfaces, respectively, which are inclined upward relative to a central portion in the sheet width direction.

An image forming apparatus according to another aspect of the present disclosure includes an apparatus main body, an image forming portion, disposed in the apparatus main body, configured to form an image on a sheet, and a sheet feed apparatus configured to convey the sheet toward the image forming portion. The sheet feed apparatus includes a sheet tray, a sheet conveyance path, a sheet feed roller, a lift plate, and a guide wall. The sheet tray includes a placing surface on which the sheet is placed. The sheet conveyance path is a path which is extended from the sheet tray and through which the sheet is conveyed in a predetermined sheet conveyance direction. The sheet feed roller is disposed, downstream of the sheet tray in the sheet conveyance direction, above a central portion of the sheet tray in a sheet width direction perpendicular to the sheet conveyance direction, so as to face the central portion of the sheet tray, and the sheet feed roller is rotationally driven to feed the sheet into the sheet conveyance path. The lift plate is disposed on the downstream side of the sheet tray in the sheet conveyance direction to support the sheet on a top surface thereof, and the lift plate is movable upward and downward to allow the sheet to contact with the sheet feed roller. The guide wall is disposed downstream of the lift plate in the sheet conveyance direction and spaced from the lift plate with a predetermined gap, to guide the sheet conveyed by the sheet feed roller in a diagonally upward direction intersecting the placing surface. Both end portions in the sheet width direction in a front edge portion, of the lift plate, facing the guide wall are provided with end guide surfaces, respectively, which are inclined upward relative to a central portion in the sheet width direction.

An image reading apparatus according to another aspect of the present disclosure includes an apparatus main body, a sheet feed apparatus, disposed in the apparatus main body, configured to convey a sheet as a document, and a reading portion, disposed so as to face a sheet conveyance path included in the sheet feed apparatus, configured to read an image on the document. The sheet feed apparatus includes a sheet tray, the sheet conveyance path, a sheet feed roller, a lift plate, and a guide wall. The sheet tray includes a placing surface on which the sheet is placed. The sheet conveyance path is a path which is extended from the sheet tray and through which the sheet is conveyed in a predetermined sheet conveyance direction. The sheet feed roller is disposed, downstream of the sheet tray in the sheet conveyance direction, above a central portion of the sheet tray in a sheet width direction perpendicular to the sheet conveyance direction, so as to face the central portion of the sheet tray, and the sheet feed roller is rotationally driven to feed the sheet into the sheet conveyance path. The lift plate is disposed on the downstream side of the sheet tray in the sheet conveyance direction to support the sheet on a top surface thereof, and the lift plate is movable upward and downward to allow the sheet to contact with the sheet feed roller. The guide wall is disposed downstream of the lift plate in the sheet conveyance direction and spaced from the lift plate with a predetermined gap, to guide the sheet conveyed by the sheet feed roller in a diagonally upward direction intersecting the placing surface. Both end portions in the sheet width direction in a front edge portion, of the lift plate, facing the guide wall are provided with end guide surfaces, respectively, which are inclined upward relative to a central portion in the sheet width direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
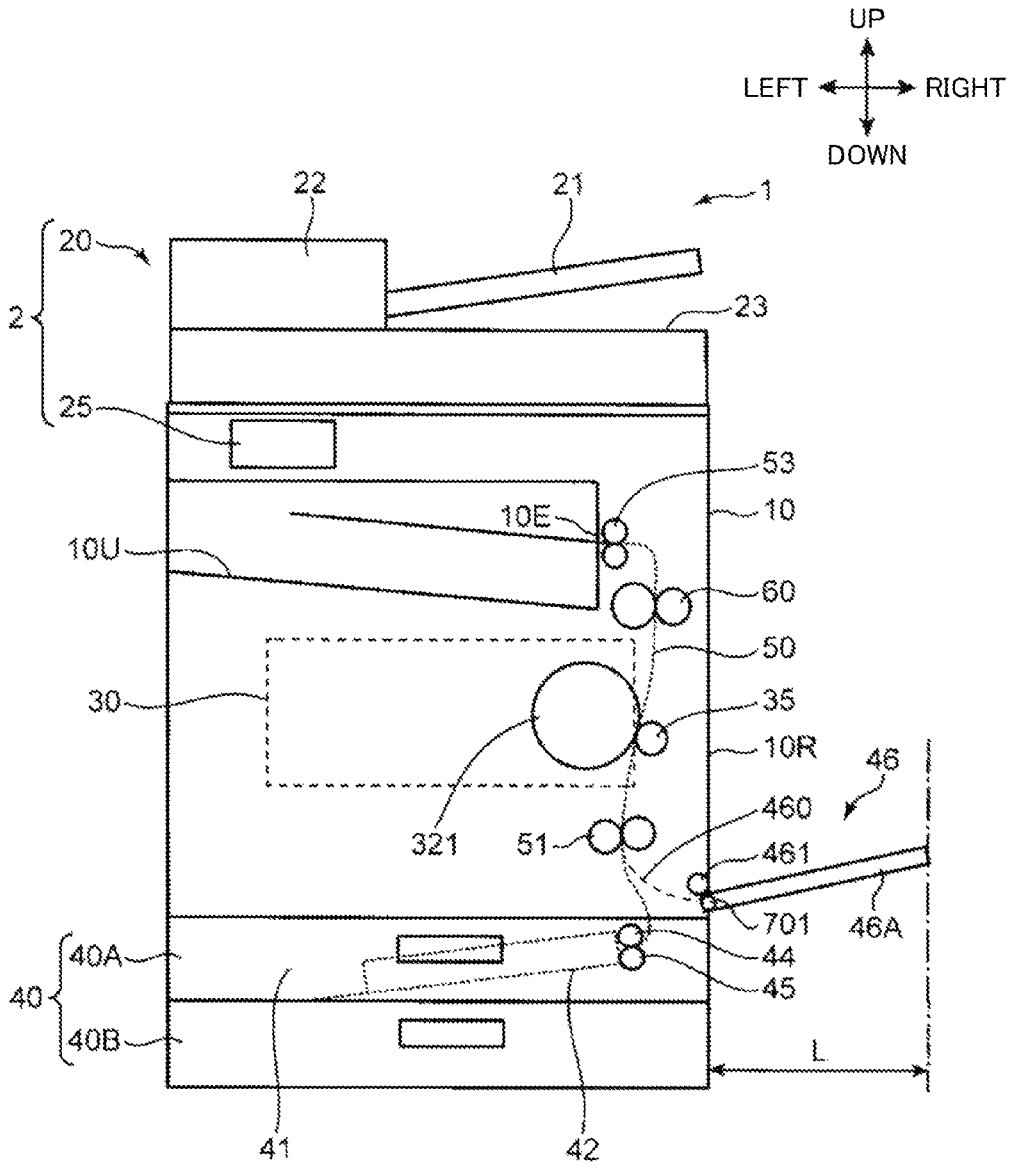
FIG. 1 is a schematic cross-sectional view showing a structure of an image forming apparatus according to an embodiment of the present disclosure.
Figure 2:
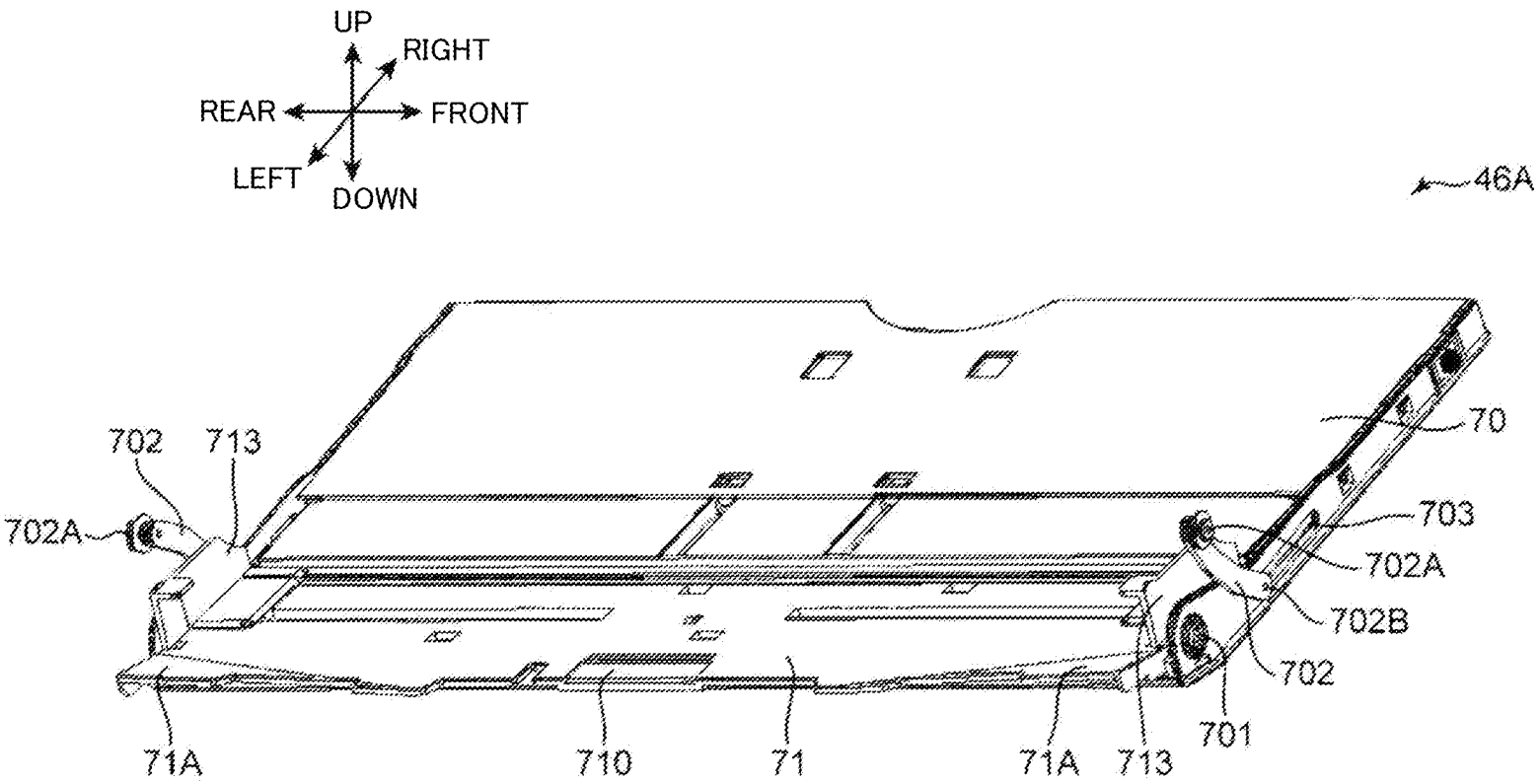
FIG. 2 is a perspective view of a manual sheet feed tray according to the embodiment of the present disclosure.

Hereinafter, embodiments of the present disclosure will be described in detail with reference to the drawings. FIG. 1 is a schematic sectional view showing an internal structure of an image forming apparatus 1 according to one embodiment of the present disclosure. While a multifunction peripheral having a printing function and a copying function is described as an example of the image forming apparatus 1, the image forming apparatus may be a printer, a copying machine, a facsimile apparatus, or the like.

<Description of Image Forming Apparatus>

The image forming apparatus 1 includes an apparatus main body 10 having a housing structure with a substantially rectangular parallelepiped shape and an automatic document feeder 20 disposed on the apparatus main body 10. The apparatus main body 10 accommodates: a reading unit 25 (reading portion) that optically reads a document image to be copied; an image forming portion 30 that forms a toner image on a sheet; a fixing portion 60 that fixes the toner image on the sheet; a sheet feed portion 40 that stores standard-size sheets to be conveyed to the image forming portion 30; and a conveyance path 50 in which the standard-size sheets are conveyed from the sheet feed portion 40 or a manual sheet feed portion 46 to a sheet discharge outlet 10E via the image forming portion 30 and the fixing portion 60.

The automatic document feeder (ADF) 20 is pivotably attached to a top surface of the apparatus main body 10. The ADF 20 automatically feeds a document sheet to be copied toward a predetermined document reading position in the apparatus main body 10. On the other hand, when a user manually places a document sheet on the predetermined document reading position, the ADF 20 is opened upward. The ADF 20 includes a document tray 21 on which a document sheet is placed, a document conveyance portion 22 that conveys the document sheet via the document reading position, and a document discharge tray 23 to which the document sheet having been read is discharged.

In the top surface of the apparatus main body 10, a contact glass for reading of the document sheet automatically fed by the ADF 20 or a contact glass (not shown) for reading of the document sheet manually placed is disposed. The reading unit 25 optically reads an image on the document sheet through the contact glasses. The automatic document feeder (ADF) 20 and the reading unit 25 form an image reading apparatus 2 described below.

The image forming portion 30 performs processing of generating a toner image and transferring the toner image onto a sheet according to a publicly known electrophotographic method. In another embodiment, another image forming method such as an inkjet method may be employed. The image forming portion 30 includes a photosensitive drum 321, and a charging device, an exposure device, a developing device, and a cleaning device, which are not shown, and a transfer roller 35 (transfer portion), which are arranged around the photosensitive drum 321.

The sheet feed portion 40 includes two sheet feed cassettes, that is, a first sheet feed cassette 40A and a second sheet feed cassette 40B, which store standard-size sheets P among sheets to be subjected to image forming processing. These sheet feed cassettes can be drawn forward on the front side of the apparatus main body 10. The first sheet feed cassette 40A includes a sheet storage portion 41 that stores a sheet stack of the standard-size sheets P and a lift plate 42 that lifts up the sheet stack for sheet feeding. On the upper portion of the right end side portion of the sheet feed cassette 40A, a not-illustrated pickup roller and a roller pair including a sheet feed roll 44 and a retard roller 45 are disposed. The uppermost sheet P of the sheet stack in the sheet feed cassette 40A is fed one by one by driving of the pickup roller and the sheet feed roll 44, and conveyed into an upstream end of the conveyance path 50. The second sheet feed cassette 40B has the same structure as the first sheet feed cassette 40A.

The manual sheet feed portion 46 (sheet feed apparatus) is disposed in a right side surface 10R of the apparatus main body 10. The manual sheet feed portion 46 includes a manual sheet feed tray 46A (sheet tray) for allowing manual sheet feeding and a sheet feed roller 461 (conveyance portion). The manual sheet feed tray 46A is attached to the apparatus main body 10 so as to be openable and closable about pivots 701 provided at the lower end portions of the manual sheet feed tray 46A. In the case of manual sheet feeding, a user opens the manual sheet feed tray 46A as shown in the drawings and places a sheet thereon. The sheet feed roller 461 is rotationally driven to feed the sheet in a sheet conveyance direction. The sheet placed on the manual sheet feed tray 46A is conveyed, by the driving of the sheet feed roller 461, into a manually fed sheet conveyance path 460 (sheet conveyance path) extended from the manual sheet feed tray 46A. The sheet is further conveyed from the manually fed sheet conveyance path 460 into the conveyance path 50.

The conveyance path 50 is extended from the sheet feed portion 40 to the sheet discharge outlet 10E via the image forming portion 30 and the fixing portion 60. In the conveyance path 50, a registration roller pair 51 is disposed upstream of a transfer nip portion. The sheet is temporarily stopped at the registration roller pair 51 in stopping state, where skew correction is performed. Thereafter, the sheet is fed to the transfer nip portion for image transfer at a predetermined time as the registration roller pair 51 is rotationally driven by a drive portion (not shown). In addition, a plurality of sheet conveyance rollers, which are not shown, for the sheet conveyance are disposed along the conveyance path 50. A sheet discharge roller 53 is disposed at the downstream end of the conveyance path 50. The sheet discharge roller 53 discharges the sheet P through the sheet discharge outlet 10E. The sheet P is discharged through the sheet discharge outlet 10E to a sheet discharge portion 10U and stacked thereon. The fixing portion 60 performs fixing processing to fix a toner image on the sheet. A pressure roller is pressed against a not-illustrated fixing roller, to form a fixing nip portion. The sheet passes through the fixing nip portion, and thereby the toner image transferred to the sheet is fixed on the sheet.

<Sheet Feed Apparatus and Sheet Tray>

Figure 3:
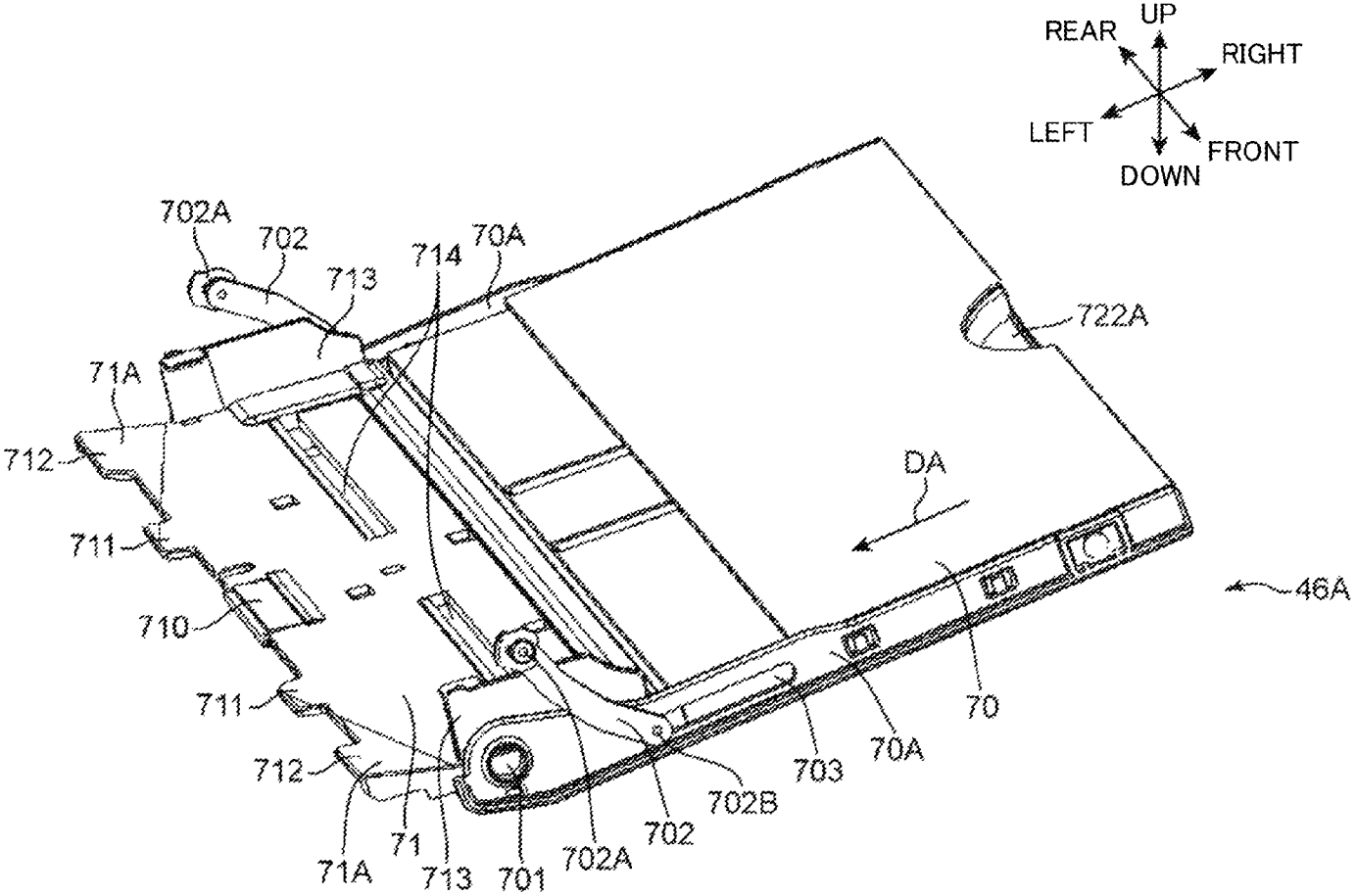
FIG. 3 is a perspective view of the manual sheet feed tray according to the embodiment of the present disclosure.
Figure 4:
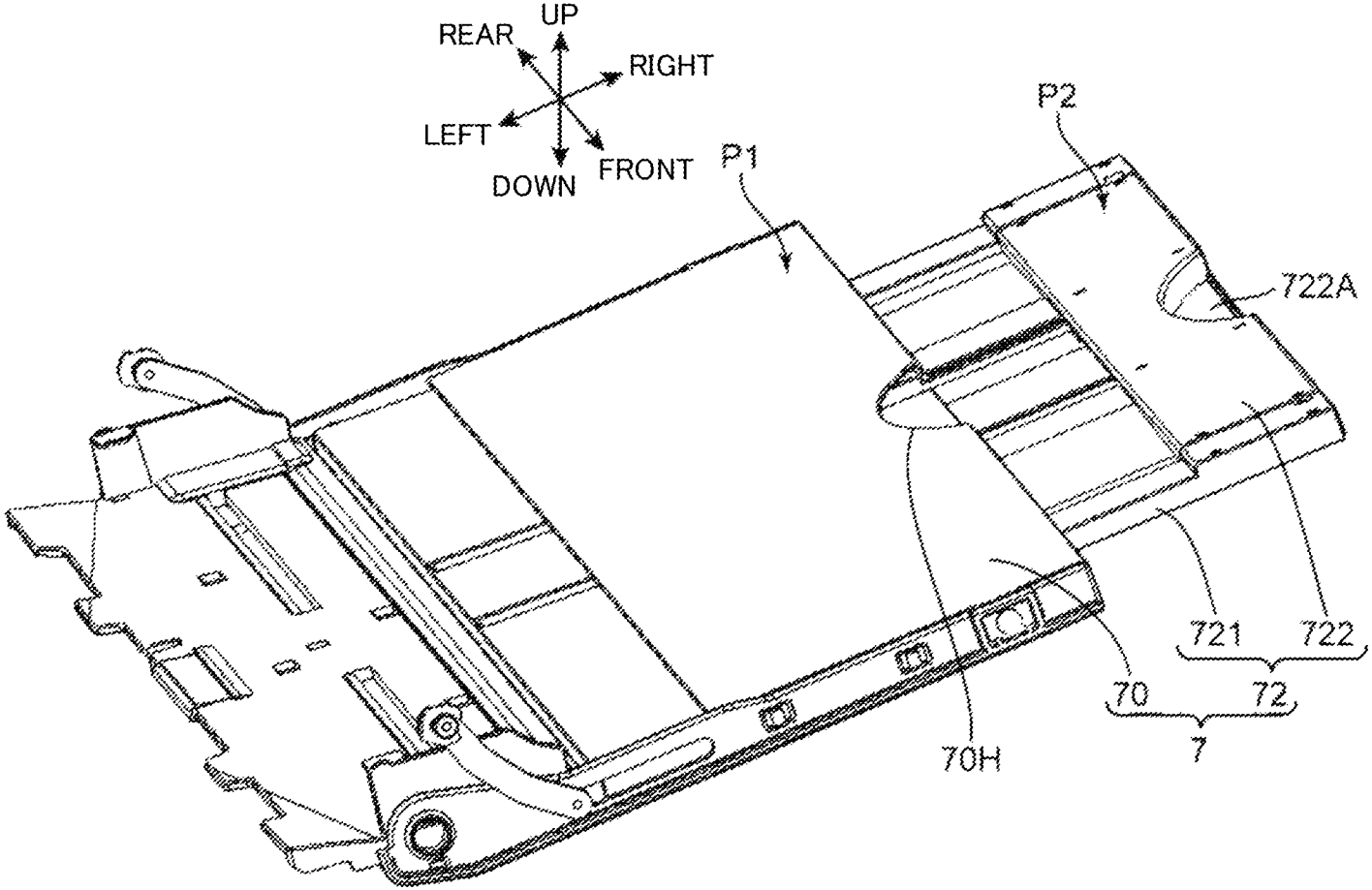
FIG. 4 is a perspective view of the manual sheet feed tray according to the embodiment of the present disclosure in a state in which an auxiliary tray is drawn out.
Figure 5:
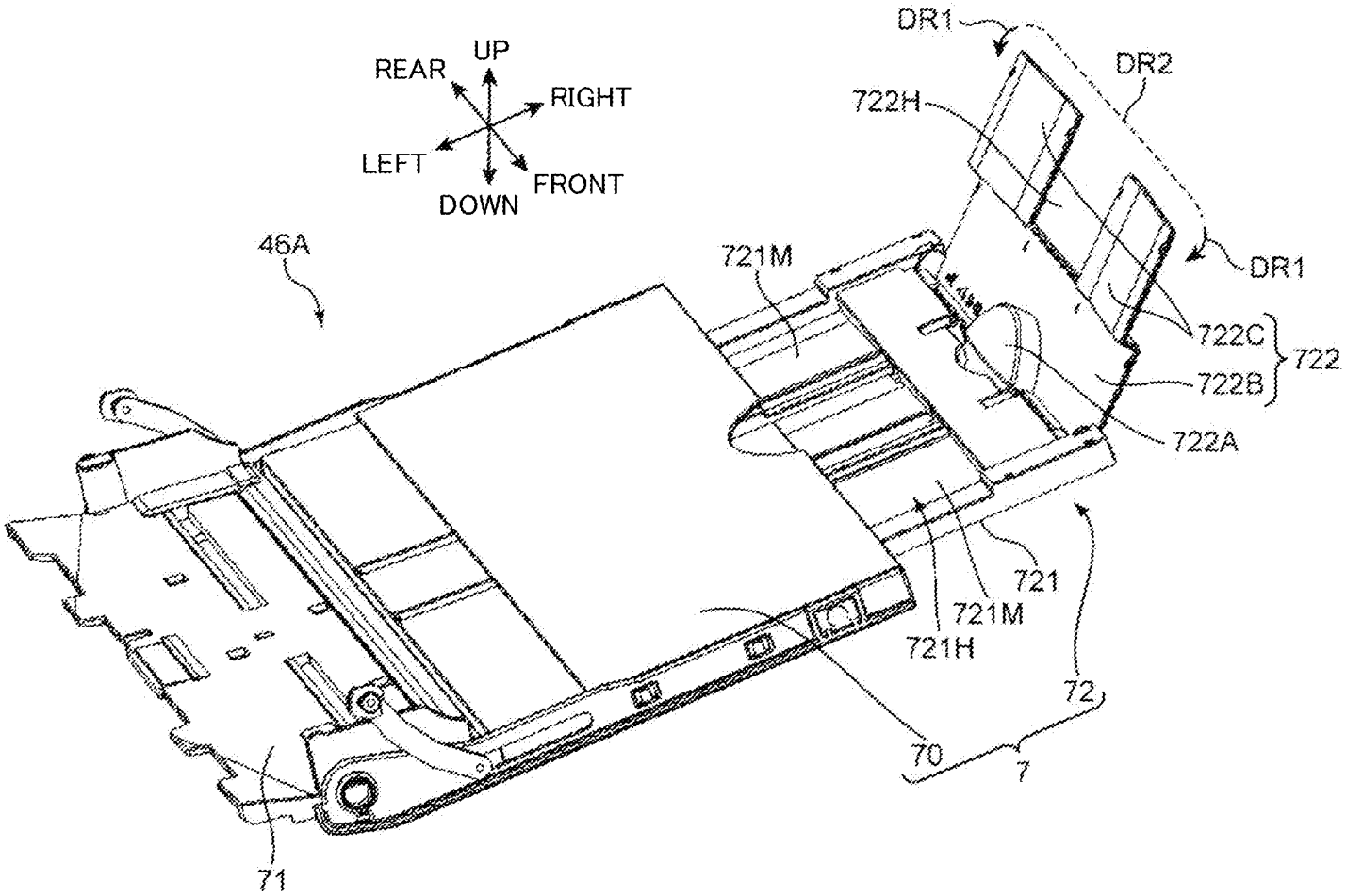
FIG. 5 is a perspective view of the manual sheet feed tray according to the embodiment of the present disclosure in a state in which a second auxiliary tray is opened.

Next, a configuration of the manual sheet feed tray 46A (sheet tray) of the manual sheet feed portion 46 (sheet feed apparatus) according to the present embodiment will be described in detail with reference to FIG. 2 to FIGS. 6A and 6B as well as FIG. 1. FIG. 3 shows a state in which an auxiliary tray 72 is accommodated in a tray main body 70, FIG. 4 shows a state in which the auxiliary tray 72 is drawn (extended) from the tray main body 70, and FIG. 5 shows a state in which a second auxiliary tray 722 of the auxiliary tray 72 is opened with respect to a first auxiliary tray 721.

The manual sheet feed tray 46A includes the tray main body 70 and the auxiliary tray 72. The tray main body 70 and the auxiliary tray 72 form a tray portion 7 of the manual sheet feed tray 46A (see FIG. 4). The tray portion 7 has, as a top surface thereof, a sheet placing surface (placing surface) on which a sheet having a predetermined width in a front-rear direction is placed. The tray main body 70 is a main body of the manual sheet feed tray 46A. The tray main body 70 is a plate-like member having a substantially rectangular shape extended in the front-rear direction and in the left-right direction. A pair of side walls 70A is provided to stand on both ends of the tray main body 70 in the front-rear direction (FIG. 3). The tray main body 70 includes the pivots 701, latching portions 702, and guide grooves 703. The tray main body 70 further includes a lift plate 71.

The pivots 701 act as a pivot about which the manual sheet feed tray 46A pivots with respect to the apparatus main body 10. A not-illustrated shaft disposed in the right side surface 10R of the apparatus main body 10 is inserted into the pivots 701. The latching portions 702 are arm members attached to the side walls 70A. The latching portions 702 define an angle at which the manual sheet feed tray 46A is opened or closed with respect to the apparatus main body 10. The latching portions 702 each include a latching pivot 702A and a groove engagement portion 702B. The latching pivot 702A is disposed at one end of each latching portion 702 and secured to a not-illustrated fixing portion disposed in the right side surface 10R of the apparatus main body 10. The groove engagement portion 702B is a projection disposed at the other end of each latching portion 702 and inserted in the guide groove 703. The guide grooves 703 are provided in the pair of side walls 70A so as to be extended in the sheet conveyance direction along edge faces of a sheet placed on the manual sheet feed tray 46A. The groove engagement portions 702B move along the guide grooves 703, and thereby opening and closing of the manual sheet feed tray 46A with respect to the apparatus main body 10 is guided. The angle at which the manual sheet feed tray 46A is opened is defined by the groove engagement portions 702B being latched at the left end portions of the guide grooves 703.

The lift plate 71 is a plate-like member disposed at the downstream side of the sheet placing surface of the tray main body 70 in the sheet conveyance direction (direction of an arrow DA in FIG. 3). The lift plate 71 supports a sheet on the top surface thereof, and a downstream end portion of the lift plate 71 in the sheet conveyance direction can be lifted and lowered with respect to the tray main body 70 by a not-illustrated lifting and lowering mechanism. The sheet placed on the tray main body 70 including the lift plate 71 is allowed to contact with the sheet feed roller 461 (FIG. 1) according to the downstream end portion of the lift plate 71 being lifted. To describe the lift plate 71 in other words, the lift plate 71 is a portion of the tray portion 7 which is extended in the sheet width direction along one edge of the sheet placed on the sheet placing surface to support the sheet. The lift plate 71 includes a sheet feed pad 710, inner guide pieces 711, outer guide pieces 712, cursors 713, and cursor guide grooves 714.

The sheet feed pad 710 is disposed on a central portion of the lift plate 71 in the sheet width direction (front-rear direction) on the head side of the lift plate 71 in the sheet conveyance direction (sheet longitudinal direction). The sheet feed pad 710 prevents multi feed of sheets. The sheet feed pad 710 is formed as a rubber member. The inner guide pieces 711 are a pair of projections provided so as to project in the sheet conveyance direction from an edge of the lift plate 71 on a downstream side in the sheet conveyance direction. The inner guide pieces 711 are disposed lateral to the sheet feed pad 710 in the sheet width direction. The outer guide pieces 712 are a pair of projections provided outward of the inner guide pieces 711 in the sheet width direction, that is, in both end portions of the lift plate 71 in the sheet width direction, so as to project in the sheet conveyance direction. The inner guide pieces 711 and the outer guide pieces 712 have a function of guiding a sheet being conveyed from the manual sheet feed tray 46A.

The cursors 713 are disposed in pairs inward of the pair of latching portions 702 and disposed so as to be movable in the front-rear direction with respect to the lift plate 71. The cursors 713 define a position of a sheet placed on the tray main body 70 in the sheet width direction. The cursors 713 are moved by a not illustrated rack and pinion mechanism in the front-rear direction along the cursor guide grooves 714 formed in the lift plate 71.

Referring to FIGS. 4 and 5, the auxiliary tray 72 is drawable rightward from the tray main body 70. Thus, a not-illustrated space which allows the auxiliary tray 72 to be accommodated therein is formed inside the tray main body 70. A user of the manual sheet feed tray 46A draws the auxiliary tray 72 out of the tray main body 70, by grasping a grip portion 722A formed in the auxiliary tray 72. The tray main body 70 has a semicircular cut portion 70H formed so as to correspond to the grip portion 722A. The auxiliary tray 72 is extended from the tray main body 70 to allow a sheet having an increased length to be placed on the manual sheet feed tray 46A. To describe the tray main body 70 and the auxiliary tray 72 in other words, the tray main body 70 allows a sheet having a first length in the sheet conveyance direction (sheet length direction) to be placed thereon, and the auxiliary tray 72 is extendable from the tray main body 70 in the sheet length direction so as to move away from the lift plate 71. The auxiliary tray 72 together with the tray main body 70 allows a sheet having a second length that is larger than the first length to be placed thereon.

Figure 6A:
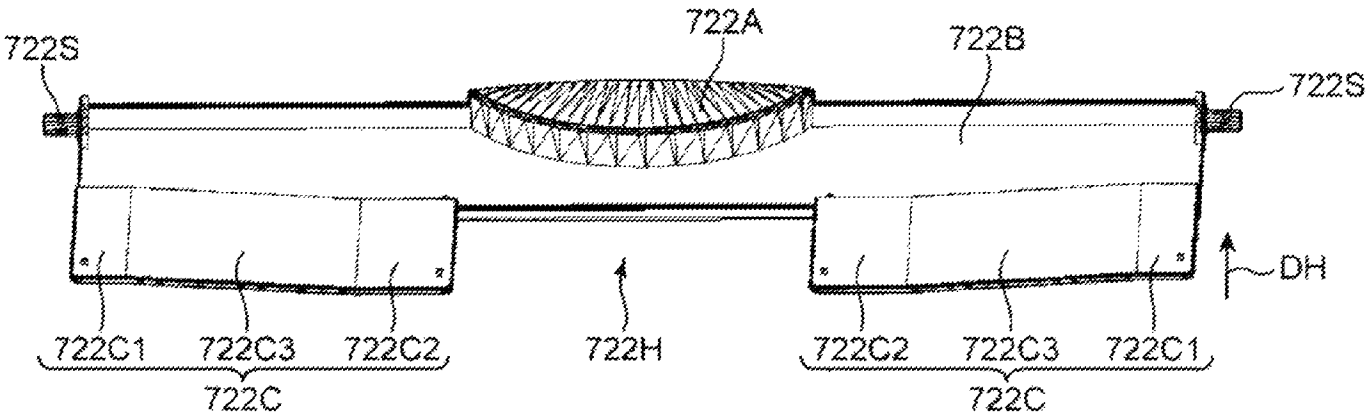
FIG. 6A is a perspective view of the second auxiliary tray of the manual sheet feed tray according to the embodiment of the present disclosure.
Figure 6B:
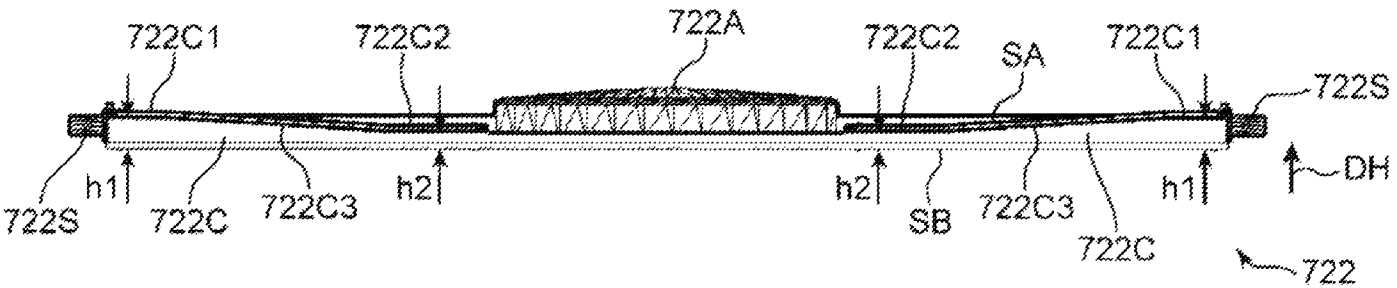
FIG. 6B is a side view of the second auxiliary tray.

The auxiliary tray 72 includes the first auxiliary tray 721 and the second auxiliary tray 722. The first auxiliary tray 721 is supported so as to be extendable from the tray main body 70 in the sheet length direction and disposed in parallel with the tray main body 70. The length of the first auxiliary tray 721 in the sheet width direction is smaller than that of the tray main body 70. The second auxiliary tray 722 is disposed on the first auxiliary tray 721. Referring to FIGS. 4 and 5, the second auxiliary tray 722 is supported so as to be openable with respect to the first auxiliary tray 721 and can switch between an opened state in which the second auxiliary tray 722 is extended from the first auxiliary tray 721 at least in the sheet length direction (FIG. 5) and a closed state in which the second auxiliary tray 722 together with the first auxiliary tray 721 can be accommodated in the tray main body 70 such that the second auxiliary tray 722 and the first auxiliary tray 721 overlap each other (FIG. 4). To describe the "being extended at least in the sheet length direction" in the opened state in other words, the second auxiliary tray 722 can be extended upward as well as in the sheet length direction in which the first auxiliary tray 721 is extended from the tray main body 70. In another embodiment, the second auxiliary tray 722 may be extended in the sheet length direction and disposed in parallel with the tray main body 70 in the opened state, as in the case of the first auxiliary tray 721. The second auxiliary tray 722 includes second auxiliary tray shafts 722S (FIGS. 6A and 6B). The second auxiliary tray shafts 722S are a pair of shafts disposed at both ends of the second auxiliary tray 722 in the sheet width direction in an edge, of the second auxiliary tray 722, which faces the first auxiliary tray 721. The second auxiliary tray 722 can switch between the above-described states by pivoting about the second auxiliary tray shafts 722S.

Referring to FIGS. 5, 6A, and 6B, the second auxiliary tray 722 includes a plate portion 722B and an extension plate 722C. The plate portion 722B is a main body of the second auxiliary tray 722 and formed as a plate-like member connected to the first auxiliary tray 721. The grip portion 722A is formed such that a central portion of the plate portion 722B in the sheet width direction on a surface facing the first auxiliary tray 721 (semicircular cut portion 70H) is recessed so as to form a semicircular shape.

The extension plate 722C is a plate-like member that is extended from the plate portion 722B. In the opened state of the second auxiliary tray 722 shown in FIG. 5, the extension plate 722C is extended from the plate portion 722B in a direction in which it moves away from the lift plate 71. Therefore, in the opened state of the second auxiliary tray 722, the extension plate 722C supports a back end portion of a sheet in the sheet length direction on a side opposite to the lift plate 71 side. In addition, a sheet depression portion 722H (cut portion) is formed at a central portion of the extension plate 722C in the sheet width direction (front-rear direction). In other words, the sheet depression portion 722H is formed by cutting a part of the central portion, in the sheet width direction, of the extension plate 722C of the second auxiliary tray 722 having the plate-like shape.

Referring to FIGS. 6A and 6B, the extension plate 722C of the second auxiliary tray 722 according to the present embodiment has such a shape that the extension plate 722C is inclined in the sheet width direction. That is, the extension plate 722C has outer supporting portions 722C1, inner supporting portions 722C2, and middle portions 722C3. Each outer supporting portion 722C1 is an outer region of the extension plate 722C in the sheet width direction. Each inner supporting portion 722C2 is an inner region of the extension plate 722C in the sheet width direction. Each middle portion 722C3 connects between the outer supporting portion 722C1 and the inner supporting portion 722C2 in the sheet width direction. The outer supporting portions 722C1 and the inner supporting portions 722C2 are substantially horizontally disposed, and the middle portions 722C3 are inclined. The inner supporting portions 722C2 face the sheet depression portions 722H in the sheet width direction. The outer supporting portions 722C1 project relative to the inner supporting portions 722C2 in a direction (a direction of an arrow DH in FIGS. 6A and 6B) perpendicular to the sheet placing surface (a surface of a sheet placed on the plate portion 722B) of the plate portion 722B. Namely, in the extension plate 722C that is a back end portion, on the upstream side in the sheet conveyance direction, of the second auxiliary tray 722 in the opened state, both end portions in the sheet width direction project upward relative to the central portion in the sheet width direction. More specifically, the outer supporting portions 722C1 project relative to the inner supporting portions 722C2 on the sheet placing surface side. Referring to FIG. 6B, the relationship of h1>h2 is satisfied, wherein h1 is a height of the outer supporting portions 722C1 and h2 is a height of the inner supporting portions 722C2 based on a surface SB that is opposite to a surface SA of the second auxiliary tray 722 on which a sheet is placed. To describe the relationship in other words, both end portions of the extension plates 722C of the second auxiliary tray 722 in the sheet width direction project in the direction perpendicular to the sheet surface relative to a central portion of the extension plates 722C in the sheet width direction.

An accommodating portion 721H (FIG. 5) is formed in the left portion of the first auxiliary tray 721 by the first auxiliary tray 721 being partially recessed along the front-rear and left-right directions, so as to correspond to the above-described shape of the extension plate 722C. Since the extension plate 722C is accommodated in the accommodating portion 721H, the thickness of the auxiliary tray 72 when the first auxiliary tray 721 and the second auxiliary tray 722 are integrated is reduced. In the first auxiliary tray 721, a portion that defines the bottom surface of the accommodating portion 721H includes a pair of tapered surfaces 721M. The pair of tapered surfaces 721M includes inclined surfaces that are inclined downward from the central portion to the end portions in the sheet width direction. Each inclined surface corresponds to the inclination between the outer supporting portion 722C1 and the inner supporting portion 722C2. The tapered surfaces 721M allow the extension plate 722C to be accommodated in the accommodating portion 721H so as to reduce the thickness of the auxiliary tray 72 as much as possible.

As shown in FIG. 5, the second auxiliary tray 722 is extended substantially upward at a predetermined angle relative to the first auxiliary tray 721 when the auxiliary tray 72 is drawn rightward from the tray main body 70, and the second auxiliary tray 722 is opened with respect to the first auxiliary tray 721. Therefore, when a sheet having a length larger than the total of the length of the tray main body 70 and the length of the first auxiliary tray 721 is placed on the manual sheet feed tray 46A, a back end portion of the sheet in the sheet conveyance direction is curved upward. Thus, the space around the manual sheet feed tray 46A to be occupied by the sheet in the sheet length direction is reduced as much as possible. In other words, a tray projection length L in FIG. 1 can be reduced as compared to a case where the length of the manual sheet feed tray 46A is set so as to correspond to the maximum possible length of a sheet to be placed on the manual sheet feed tray 46A.

Furthermore, of the sheets placed on the manual sheet feed tray 46A, a portion, of a sheet, in contact with the extension plate 722C is deformed according to the inclined shape of the extension plate 722C. As described above, the outer supporting portions 722C1 project relative to the inner supporting portions 722C2 in the direction perpendicular to the surface of the placed sheet (direction of the arrow DH in FIGS. 6A and 6B). Therefore, both end portions of the surface of the sheet, in the sheet width direction, which are supported by the extension plates 722C, are pressed by the outer supporting portions 722C1 in directions of arrows DR1 in FIG. 5. As a result, a deformed shape as represented by an arrow DR2 (including the arrows DR1) in FIG. 5 is formed at the back end portions of the sheets such that both end portions in the sheet width direction are warped toward the central portion in the sheet width direction. Furthermore, the extension plate 722C according to the present embodiment has the above-described sheet depression portion 722H. Thus, the sheet depression portion 722H allows the central portion of the sheet in the sheet width direction to be slightly depressed when the sheet is deformed as described above. As a result, the sheet is more easily deformed.

As described above, the sheet placed on the manual sheet feed tray 46A is deformed along the sheet width direction while the second auxiliary tray 722 is in the opened state. As a result, the sheet is not easily deformed along the sheet length direction, and therefore the back end portion (the other edge side) of the sheet that is extended to the outside of the tray portion 7 beyond the extension plate 722C does not easily drop down from the tray portion 7. Thus, even when a sheet longer than the tray portion 7 is placed on the manual sheet feed tray 46A, the sheet can be prevented from falling off and held stably. In particular, the second auxiliary tray 722 in the opened state allows the back end portion of the sheet to be curved upward, and, due to the shape of the extension plate 722C, both end portions of the sheet in the sheet width direction in the back end portion of the sheet, are curved toward the lift plate 71. As a result, by the synergistic effect between the curving of the sheet by the second auxiliary tray 722 and the deformation of the sheet by the extension plate 722C, the sheet is less likely to move away from the tray portion 7.

Next, the manual sheet feed portion 46 according to the present embodiment will be described in detail with reference to FIGS. 7 to 11.

Figure 7:
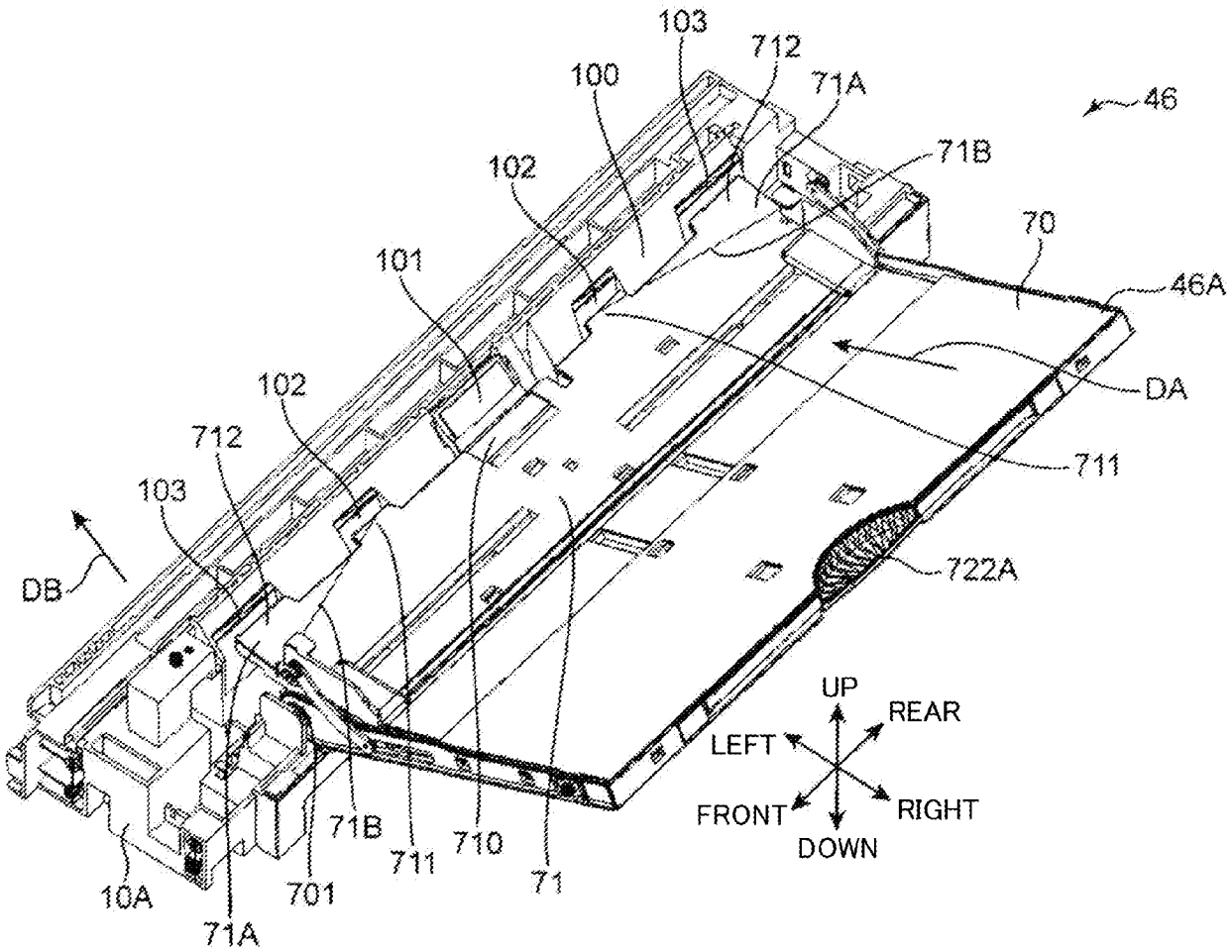
FIG. 7 is a perspective view of a manual sheet feed portion according to the embodiment of the present disclosure.
Figure 8:
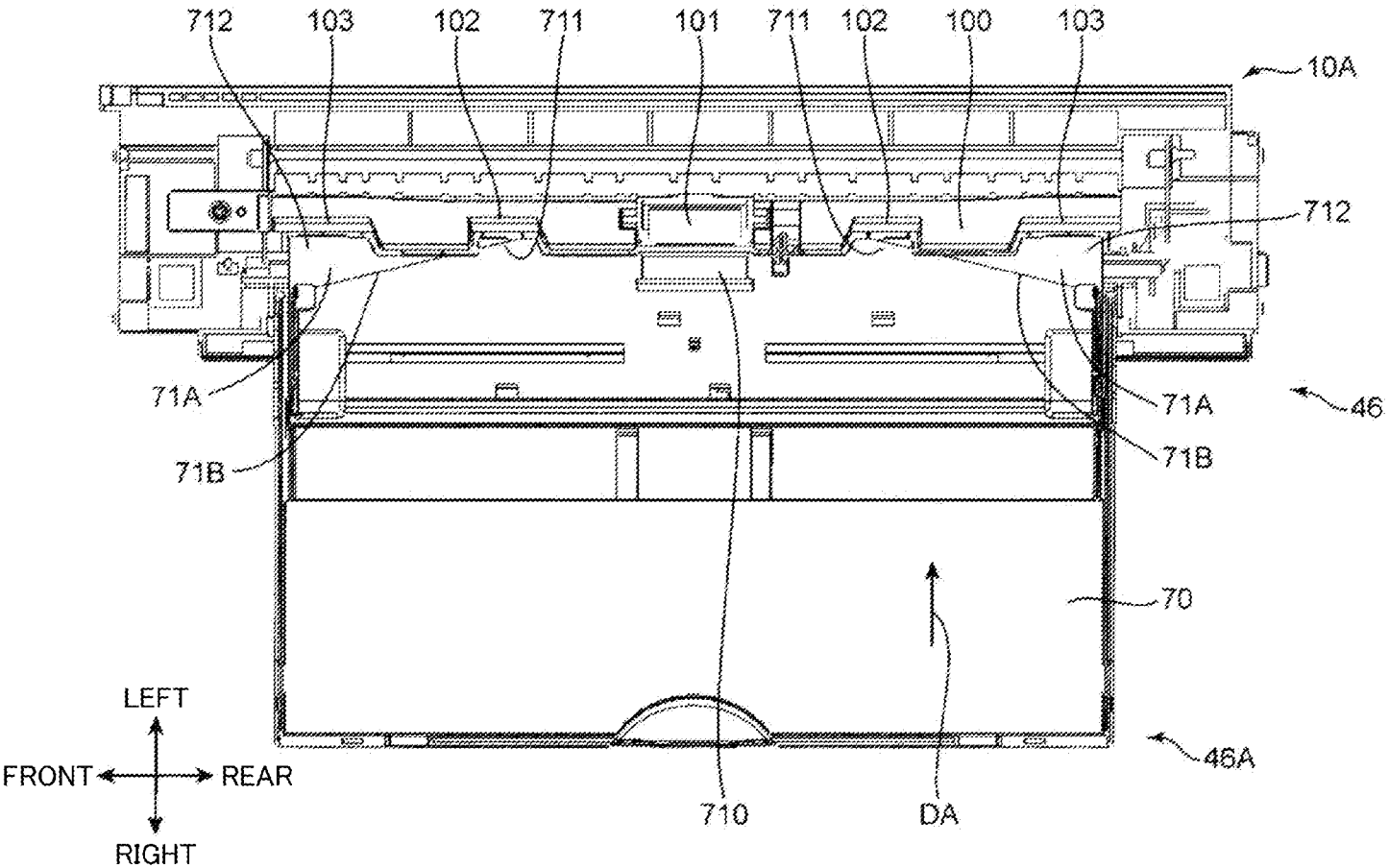
FIG. 8 is a plan view of the manual sheet feed portion according to the embodiment of the present disclosure.
Figure 9A:
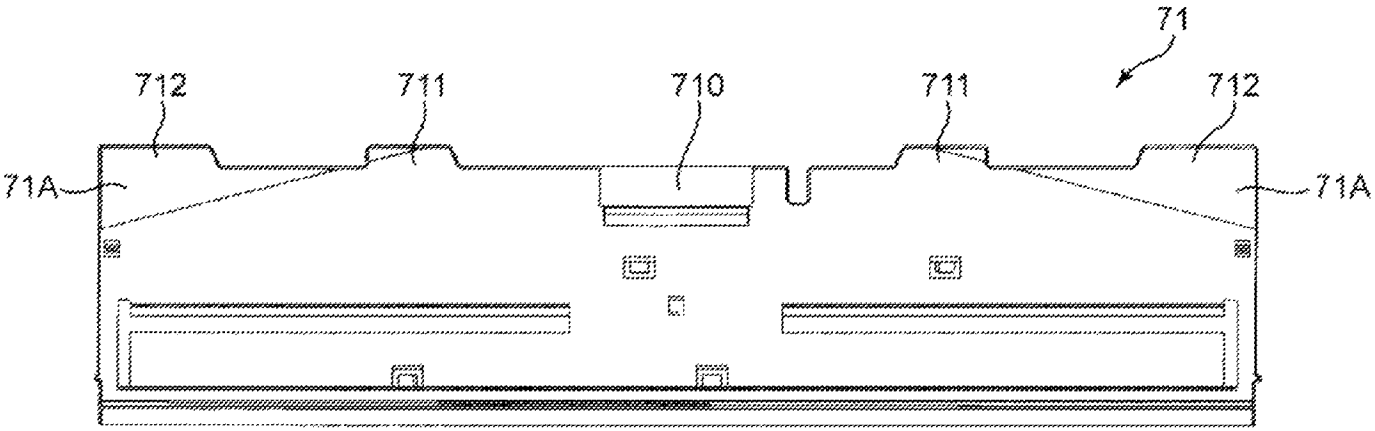
FIG. 9A is a plan view of a lift plate according to the embodiment of the present disclosure.
Figure 9B:
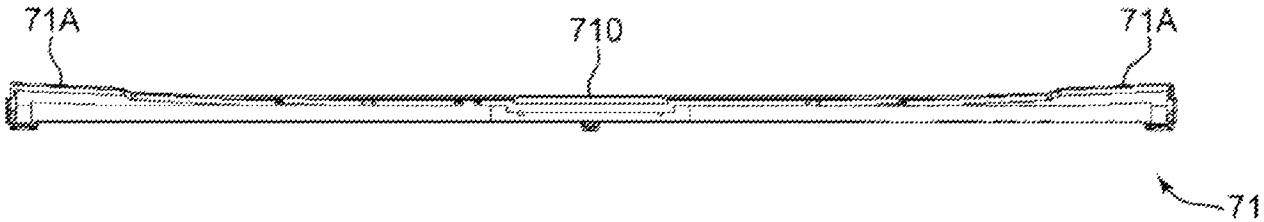
FIG. 9B is a side view thereof.
Figure 10:
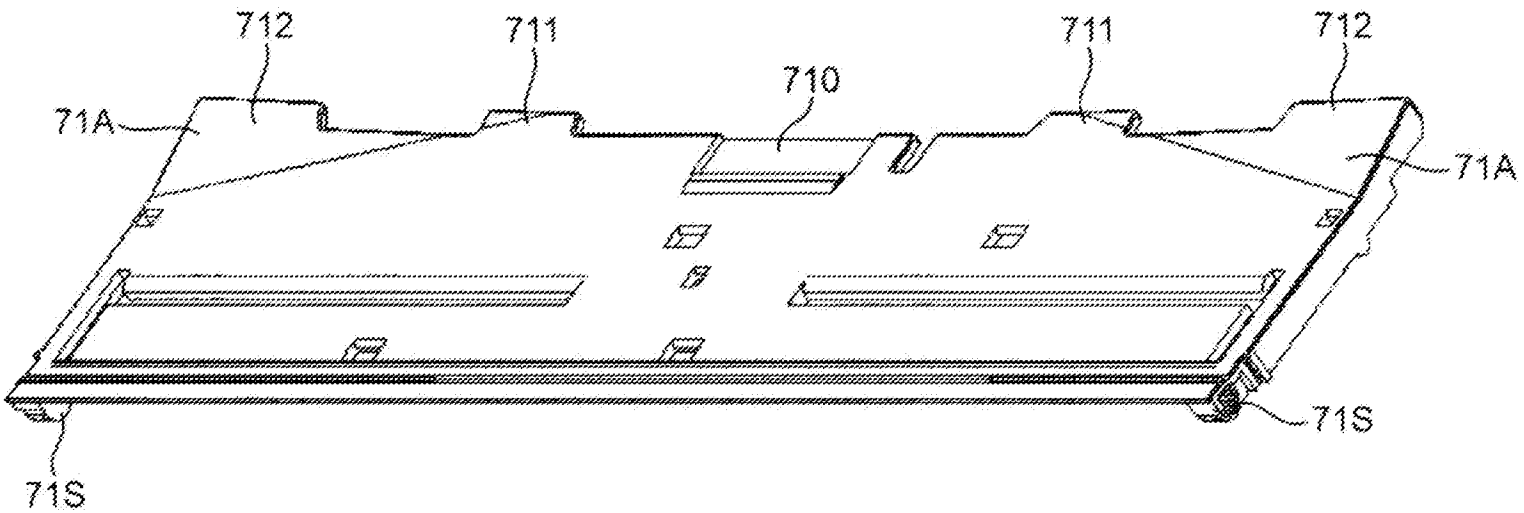
FIG. 10 is a perspective view of the lift plate according to the embodiment of the present disclosure.

Referring to FIG. 7, the manual sheet feed portion 46 includes a carry-in portion 10A. The carry-in portion 10A is disposed in a region facing the manual sheet feed tray 46A in the right side surface 10R of the apparatus main body 10 (FIG. 1). The carry-in portion 10A is a part of the housing of the apparatus main body 10. The carry-in portion 10A is a substantially rectangular parallelepiped housing that has a predetermined width in the left-right direction and that extends in the front-rear direction. As shown in FIG. 7, the pivots 701 of the manual sheet feed tray 46A are supported on a portion of the carry-in portion 10A.

The carry-in portion 10A includes a guide portion 100 (guide wall). The guide portion 100 is a wall portion disposed so as to face the lift plate 71 of the manual sheet feed tray 46A. The guide portion 100 is spaced from the lift plate 71 with a predetermined gap G in the sheet conveyance direction (see FIG. 11). The guide portion 100 guides the sheet conveyed by the sheet feed roller 461 (FIG. 1) in a sheet guiding direction (diagonally upward direction) that is a diagonally upward direction intersecting the lift plate 71 (placing surface) as viewed in a cross-section intersecting the sheet width direction (see an arrow DB in FIGS. 7 and 11).

The guide portion 100 includes a guide pad 101, inner cut portions 102, and outer cut portions 103.

The guide pad 101 is disposed on a central portion of the guide portion 100 in the sheet width direction (front-rear direction). The guide pad 101 is formed as a rubber member as in the case of the sheet feed pad 710. The guide pad 101 forms a conveyance nip portion between the guide pad 101 and a circumferential surface of the sheet feed roller 461. The sheet feed roller 461 is disposed downstream of the manual sheet feed tray 46A in the sheet conveyance direction so as to face a central portion in the sheet width direction. That is, the sheet feed roller 461 is disposed so as to face a region in which the sheet feed pad 710 and the guide pad 101 intersect with each other. The circumferential surface of the sheet feed roller 461 forms a sheet feed nip portion and the conveyance nip portion between the sheet feed pad 710 and the guide pad 101, thereby allowing a sheet to be conveyed in the sheet conveyance direction (direction of the arrow DA), and then in the sheet guiding direction (direction of the arrow DB) along the guide portion 100, as shown in FIG. 7.

The inner cut portions 102 are a pair of cut portions formed outward of the guide pad 101 in the front-rear direction in the guide portion 100. The inner cut portions 102 are disposed so as to face the inner guide pieces 711 of the lift plate 71. The inner guide pieces 711 are disposed so as to enter the inner cut portions 102. Likewise, the outer cut portions 103 are a pair of cut portions formed outward of the inner cut portions 102 in the front-rear direction in the guide portion 100. In other words, the outer cut portions 103 are disposed at both end portions of the guide portion 100 in the front-rear direction. The outer cut portions 103 are disposed so as to face the outer guide pieces 712 of the lift plate 71. The outer guide pieces 712 are disposed so as to enter the outer cut portions 103.

To describe the inner guide pieces 711 and the outer guide pieces 712 of the lift plate 71 in other words, the inner guide pieces 711 and the outer guide pieces 712 are a plurality of projections provided so as to project toward the guide portion 100 and arranged along the sheet width direction on a front edge portion, of the lift plate 71, facing the guide portion 100. Since the inner guide pieces 711 and the outer guide pieces 712 are disposed so as to enter the inner cut portions 102 and the outer cut portions 103 of the guide portion 100, comb-like shapes of the guide portion 100 and the lift plate 71 are meshed with each other so as to form the gap G. Thus, preferable sheet transfer from the lift plate 71 to the guide portion 100 is achieved.

The lift plate 71 according to the present embodiment further includes end guides 71A. The end guides 71A are end portion guide surfaces provided at both end portions of the lift plate 71 in the sheet width direction in the front edge portion, of the lift plate 71, facing the guide portion 100. The end guides 71A are formed so as to be inclined upward relative to the central portion of the lift plate 71 in the sheet width direction. More specifically, the end guides 71A are formed so as to project in the guiding direction of the guide portion 100. In other words, both the end portions of the lift plate 71 in the sheet width direction project, in an upward direction (on the sheet placing surface side) perpendicular to the sheet placing surface of the tray main body 70, relative to the central portion of the lift plate 71 in the sheet width direction. More specifically, both the end portions in the sheet width direction in the front edge portion of the lift plate 71 are bent upward so as to form surfaces intersecting the sheet conveyance direction (arrow DA in FIG. 7) and the sheet width direction (front-rear direction), thereby forming the end guides 71A. In this case, bent edge lines 71B are formed at base ends of the end guides 71A. To further describe the end guides 71A in other words, the end guides 71A are guide surfaces formed by inclining, in the guiding direction of the guide portion 100, portions of the sheet placing surface (top surface) at both the end portions in the sheet width direction in the front edge portion of the lift plate 71 on the downstream side in the sheet conveyance direction. As viewed from above each end guide 71A, each end guide 71A is formed into a right-triangular shape that includes: a right angle at the corner of the front edge portion of the lift plate 71 in the sheet width direction; two legs formed by the front edge of the lift plate 71 and a side edge of the lift plate 71 along the sheet conveyance direction; and a hypotenuse (bent edge line 71B) that extends on the sheet placing surface. The right-triangular shape is formed by bending a part of the sheet placing surface at the hypotenuse as an edge line. In other words, each end guide 71A has a shape in which the corner portion of the front edge portion of the lift plate 71 in the sheet width direction is bent upward at the hypotenuse (bent edge line 71B), as the edge line, which connects between the edge of the front edge portion and the side edge of the lift plate 71 along the sheet conveyance direction. Thus, the end guides 71A have such a shape as to be inclined in the upper direction toward the corner of each of both the end portions, in the sheet width direction, in the front edge portion.

As described above, the end guides 71A are formed stably by the inexpensive bending work. In the present embodiment, each outer guide piece 712 is a portion of each end guide 71A. In other words, each end guide 71A includes the outer guide piece 712. Accordingly, the outer guide pieces 712 disposed at the end portions in the sheet width direction project (is raised) in the guiding direction, relative to the inner guide pieces 711 disposed at the central portion in the sheet width direction.

Next, a function of the end guides 71A according to the present embodiment will be described with reference to FIG. 12 as well as FIG. 11. FIG. 12 is a perspective view of a manual sheet feed portion 46Z to be compared with the manual sheet feed portion 46 according to the present embodiment. Like the manual sheet feed portion 46, the manual sheet feed portion 46Z includes a tray main body 70Z and a lift plate 71Z. In addition, a carry-in portion 10ZA is disposed in a not-illustrated apparatus main body, so as to face the lift plate 71Z. The carry-in portion 10ZA includes a guide portion 100Z. Unlike the lift plate 71 according to the present embodiment, the lift plate 71Z does not include the end guides 71A. In other words, a central portion 71ZB and end portions 71ZA are formed so as to be flush with each other in a front edge portion, of the lift plate 71Z, facing the guide portion 100Z.

When a sheet is conveyed by a not-illustrated sheet feed roller disposed so as to face a sheet feed pad 710Z in this manual sheet feed portion 46Z, a central portion of the sheet in the sheet width direction is assuredly conveyed toward the guide portion 100Z by the sheet feed roller. On the other hand, both end portions of the sheet in the sheet width direction are not in contact with the sheet feed roller, and therefore the sheet is not held at the end portions. Accordingly, the both end portions of the sheet is likely to drop down. As a result, both end portions are likely to enter a gap 103Z between the lift plate 71Z and the guide portion 100Z, causing bending in the sheet or defective sheet conveyance.

Figure 11:
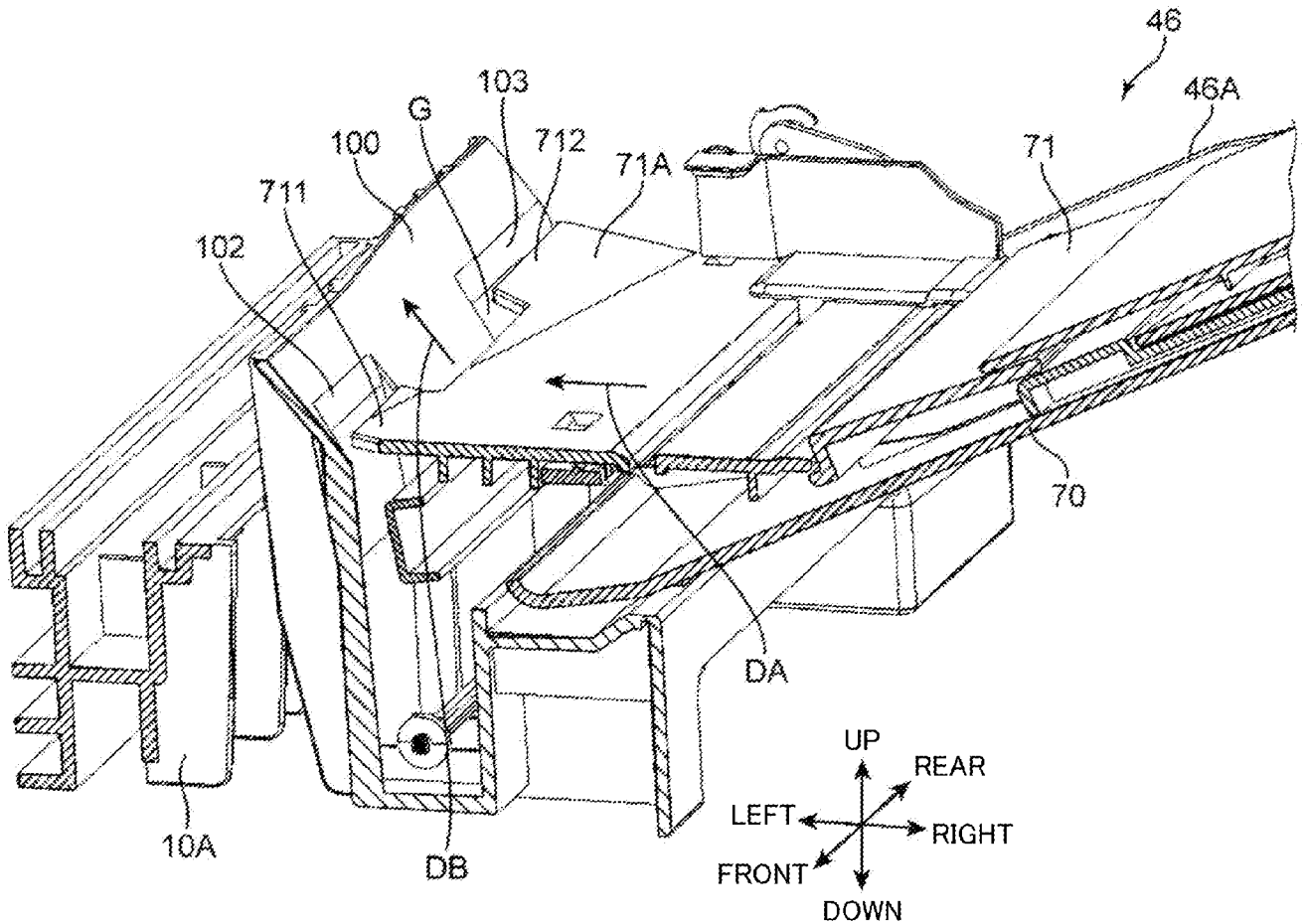
FIG. 11 is a cross-sectional perspective view of the manual sheet feed portion according to the embodiment of the present disclosure.
Figure 12:
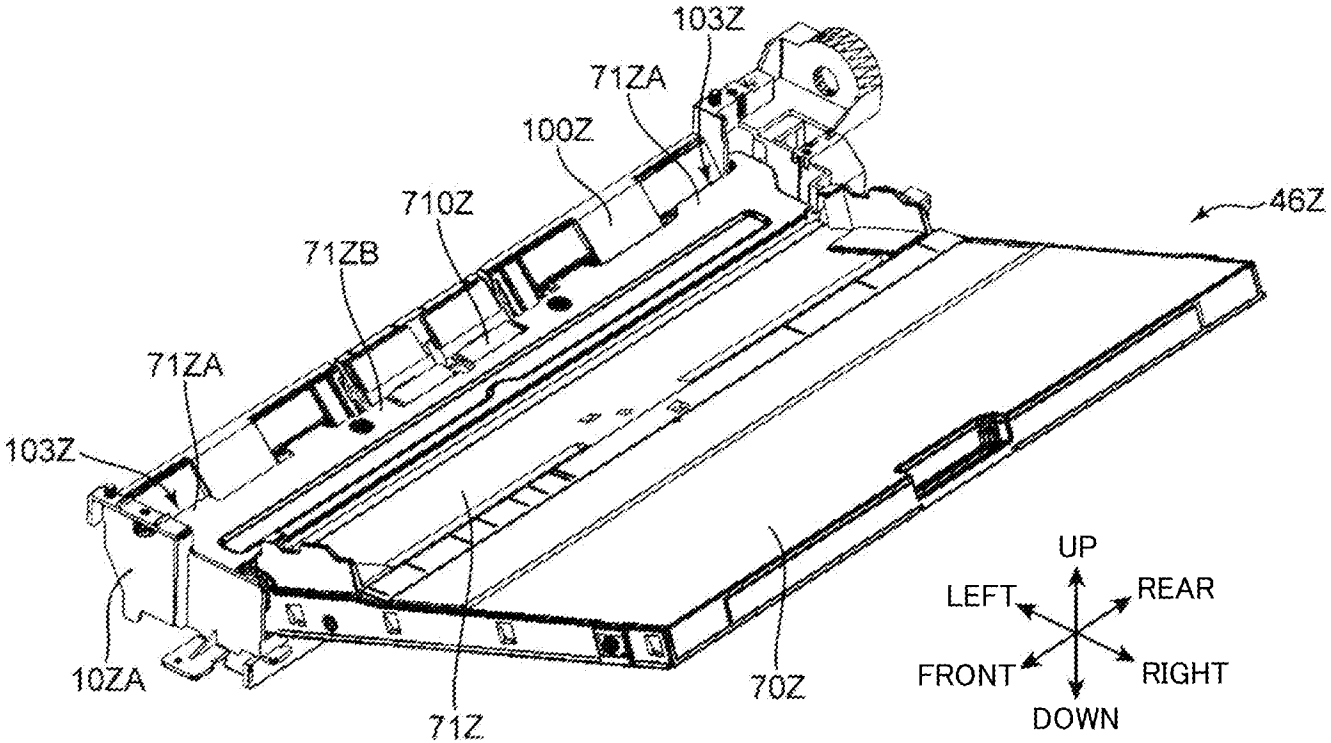
FIG. 12 is a perspective view of another manual sheet feed portion to be compared with the manual sheet feed portion according to the embodiment of the present disclosure.

As shown in FIG. 11, on the other hand, the manual sheet feed portion 46 according to the present embodiment is provided with the end guides 71A at the end portions in the sheet width direction where the sheet holding force is likely to be reduced. Thereby, the end portions of the sheet are guided toward the guide portion 100 by the end guides 71A. In other words, the end portions of the sheet are guided upward so as to move away from the gap G. Thus, bending in the sheet or defective sheet conveyance as in the manual sheet feed portion 46Z is advantageously prevented. In particular, the lift plate 71 is moved upward and downward in order to contact the sheet with the sheet feed roller 461. Accordingly, when the number of the sheets placed on the manual sheet feed tray 46A is increased, the position of the lift plate 71 with respect to the guide portion 100 is lowered. Accordingly, the sheets are more likely to enter a lower portion of the gap G. In the present embodiment, the end guides 71A project upward (are raised) to the extent that the sheets can be prevented from entering the gap G even when the lift plate 71 is in a lowermost position.

When the end guides 71A have the above-described shape, a synergistic effect between the end guides 71A and the extension plate 722C is exerted. That is, the end guides 71A and the extension plate 722C allow a sheet placed on the manual sheet feed tray 46A to be deformed in the same direction along the sheet length direction. Thus, the sheet is easily conveyed toward the guide portion 100 along the end guides 71A. Since the leading end of the sheet is deformed by the end guides 71A, the back end of the sheet is easily deformed by the extension plate 722C. As a result, even when a sheet having a length greater than the maximum length of the manual sheet feed tray 46A is placed on the manual sheet feed tray 46A, the sheet is prevented from moving away from the manual sheet feed tray 46A, with enhanced effectiveness.

While the manual sheet feed portion 46 (manual sheet feed tray 46A) and the image forming apparatus 1 including the same according to the embodiment of the present disclosure have been described as above, the present disclosure is not limited thereto, and the following modifications can be employed, for example.

In the above-described embodiment, the manual sheet feed tray 46A has been described as a sheet tray, the manual sheet feed portion 46 has been described as a sheet feed apparatus. However, the present disclosure is not limited thereto. In another embodiment, the present disclosure may be applied to the automatic document feeder 20 as a sheet feed apparatus. In this case, the reading unit 25 (reading portion) and the automatic document feeder 20 form the image reading apparatus 2. Also in this case, the shape of the lift plate 71 allows a sheet as a document to be stably fed from the document tray 21 into the sheet conveyance path. As a result, an image on the document is favorably read by the reading unit 25 disposed so as to face the sheet conveyance path.

In the above-described embodiment, the end guides 71A that stably guide a sheet toward the guide portion 100 are shaped so as to be disposed in the lift plate 71. However, the present disclosure is not limited thereto. The same shape as that of the end guides 71A may be formed also in a head portion of the tray main body 70 in the sheet length direction so as to face the guide portion 100. The shape of the end guides 71A is not limited to the shape by which the end guides 71A are bent at the bent edge lines 71B. Another shape may be used when edge guide surfaces project at least in the guiding direction, at the end portions in the sheet width direction in the head portion of the lift plate 71.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feed apparatus comprising:

a sheet tray including a placing surface on which a sheet is placed;

a sheet conveyance path which is extended from the sheet tray and through which the sheet is conveyed in a predetermined sheet conveyance direction;

a sheet feed roller disposed, downstream of the sheet tray in the sheet conveyance direction, above a central portion of the sheet tray in a sheet width direction perpendicular to the sheet conveyance direction, so as to face the central portion of the sheet tray, the sheet feed roller being rotationally driven to feed the sheet into the sheet conveyance path;

a lift plate disposed on the downstream side of the sheet tray in the sheet conveyance direction to support the sheet on a top surface thereof, the lift plate being movable upward and downward to allow the sheet to contact with the sheet feed roller; and a guide wall disposed downstream of the lift plate in the sheet conveyance direction and spaced from the lift plate with a predetermined gap, to guide the sheet conveyed by the sheet feed roller in a diagonally upward direction intersecting the placing surface, wherein both end portions in the sheet width direction in a front edge portion, of the lift plate, facing the guide wall are provided with end guide surfaces, respectively, which are inclined upward relative to a central portion in the sheet width direction.

2. The sheet feed apparatus according to claim 1, wherein the end guide surfaces are inclined in an upward direction toward corners of both the end portions, respectively, in the sheet width direction in the front edge portion.

3. The sheet feed apparatus according to claim 2, wherein the end guide surfaces are formed by bending upward corner portions of both the end portions, respectively, in the sheet width direction in the front end portion.

4. The sheet feed apparatus according to claim 1, wherein the front edge portion of the lift plate includes a plurality of projections provided so as to project toward the guide wall and arranged along the sheet width direction, and the guide wall includes a plurality of cut portions formed in positions facing the projections in such a manner that the projections enter the cut portions.

5. The sheet feed apparatus according to claim 4, wherein, of the plurality of projections, the projections disposed on both the end portions in the sheet width direction in the front edge portion form the end guide surfaces.

6. The sheet feed apparatus according to claim 4, wherein, of the plurality of projections, the projections disposed on both the end portions in the sheet width direction in the front edge portion are inclined in the diagonally upward direction, relative to the projections disposed on the central portion side in the sheet width direction.

7. The sheet feed apparatus according to claim 1, wherein, at a back end portion of the sheet tray on an upstream side in the sheet conveyance direction, both end portions in the sheet width direction project in a direction perpendicular to the placing surface, relative to a central portion in the sheet width direction.

8. The sheet feed apparatus according to claim 7, wherein, in the front edge portion and the back end portion, the sheet placed on the sheet tray is deformed in the same direction along a sheet length direction.

9. An image forming apparatus comprising:

an apparatus main body;

an image forming portion, disposed in the apparatus main body, configured to form an image on a sheet; and a sheet feed apparatus configured to convey the sheet toward the image forming portion, wherein the sheet feed apparatus includes:

a sheet tray including a placing surface on which the sheet is placed;

a sheet conveyance path which is extended from the sheet tray and through which the sheet is conveyed in a predetermined sheet conveyance direction;

a sheet feed roller disposed, downstream of the sheet tray in the sheet conveyance direction, above a central portion of the sheet tray in a sheet width direction perpendicular to the sheet conveyance direction, so as to face the central portion of the sheet tray, the sheet feed roller being rotationally driven to feed the sheet into the sheet conveyance path;

a lift plate disposed on the downstream side of the sheet tray in the sheet conveyance direction to support the sheet on a top surface thereof, the lift plate being movable upward and downward to allow the sheet to contact with the sheet feed roller; and a guide wall disposed downstream of the lift plate in the sheet conveyance direction and spaced from the lift plate with a predetermined gap, to guide the sheet conveyed by the sheet feed roller in a diagonally upward direction intersecting the placing surface, wherein both end portions in the sheet width direction in a front edge portion, of the lift plate, facing the guide wall are provided with end guide surfaces, respectively, which are inclined upward relative to a central portion in the sheet width direction.

10. An image reading apparatus comprising:

an apparatus main body;

a sheet feed apparatus, disposed in the apparatus main body, configured to convey a sheet as a document, a reading portion, disposed so as to face a sheet conveyance path included in the sheet feed apparatus, configured to read an image on the document, wherein the sheet feed apparatus comprising:

a sheet tray including a placing surface on which the sheet is placed;

the sheet conveyance path which is extended from the sheet tray and through which the sheet is conveyed in a predetermined sheet conveyance direction;

a sheet feed roller disposed, downstream of the sheet tray in the sheet conveyance direction, above a central portion of the sheet tray in a sheet width direction perpendicular to the sheet conveyance direction, so as to face the central portion of the sheet tray, the sheet feed roller being rotationally driven to feed the sheet into the sheet conveyance path;

a lift plate disposed on the downstream side of the sheet tray in the sheet conveyance direction to support the sheet on a top surface thereof, the lift plate being movable upward and downward to allow the sheet to contact with the sheet feed roller; and a guide wall disposed downstream of the lift plate in the sheet conveyance direction and spaced from the lift plate with a predetermined gap, to guide the sheet conveyed by the sheet feed roller in a diagonally upward direction intersecting the placing surface, wherein both end portions in the sheet width direction in a front edge portion, of the lift plate, facing the guide wall are provided with end guide surfaces, respectively, which are inclined upward relative to a central portion in the sheet width direction.

* * * * *